United States Patent [19]

Burnham

[11] 4,046,116

[45] Sept. 6, 1977

[54] INTERNAL COMBUSTION ENGINES

[76] Inventor: William E. Burnham, 812 Riverview Drive, Leavittsburg, Ohio 44485

[21] Appl. No.: 670,720

[22] Filed: Mar. 26, 1976

[51] Int. Cl.[2] ..... F02B 75/04

[52] U.S. Cl. ..... 123/48 R; 123/193 H; 123/193 P

[58] Field of Search ..... 123/48 R, 48 A, 48 AA, 123/191 R, 191 M, 193 CP, 193 P, 193 H, 193 R; 92/221

[56] References Cited

U.S. PATENT DOCUMENTS

| | | | |
|---|---|---|---|
| 1,489,291 | 4/1924 | Tuerk | 123/193 R |
| 1,490,849 | 4/1924 | Philip | 123/193 P |
| 1,623,940 | 4/1927 | Mader | 123/48 R |
| 1,708,426 | 4/1929 | Moore | 123/48 R |

FOREIGN PATENT DOCUMENTS

| | | | |
|---|---|---|---|
| 635,818 | 3/1928 | France | 123/48 R |
| 246,484 | 3/1926 | Italy | 123/48 R |

*Primary Examiner*—Clarence R. Gordon
*Attorney, Agent, or Firm*—Michael Williams

[57] ABSTRACT

My invention relates to means for and methods of increasing the compression ratio of the cylinders of an overhead valve engine. The means comprises a small plate of metal which is attached to the top face of the piston head. The plates are provided in various sizes so that one size may be selected to increase the compression ratio a predetermined amount.

The method comprises removal of the engine head with the overhead valves carried thereby, and the rotation of the crankshaft to bring the pistons in any desired order to substantially top dead center, and to attach the compression-increasing plate to the top face of a piston while it is at top dead center.

5 Claims, 6 Drawing Figures

FIG. 1
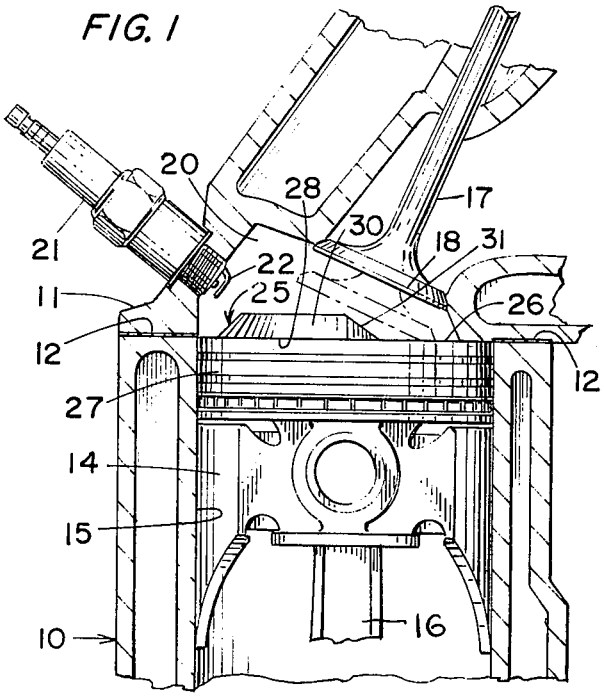
FIG. 2
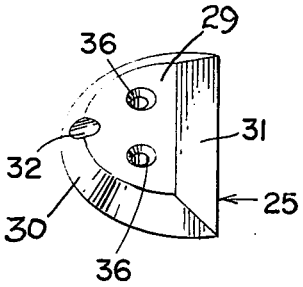
FIG. 3
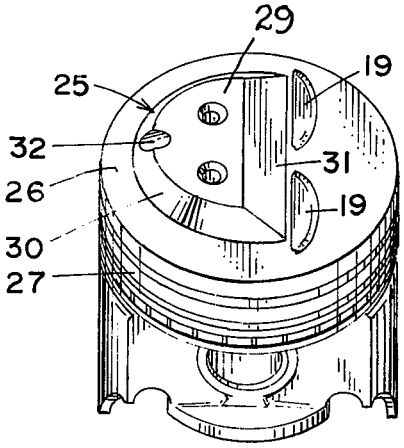
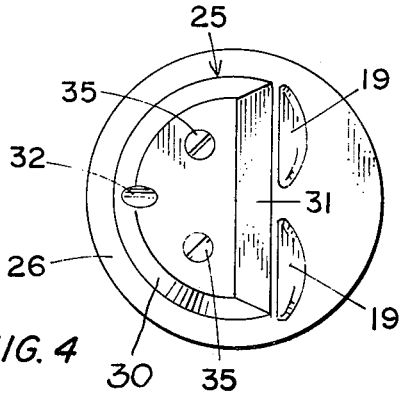
FIG. 4
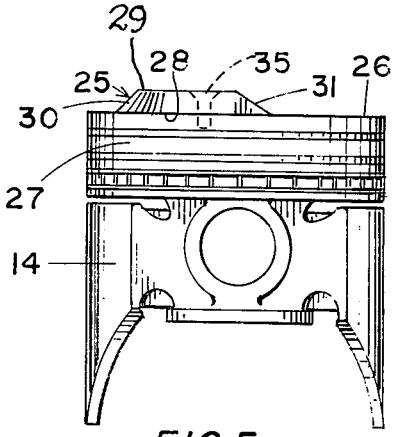
FIG. 5
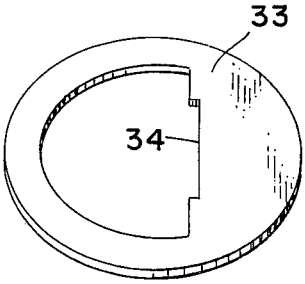
FIG. 6

INTERNAL COMBUSTION ENGINES

BACKGROUND AND SUMMARY

The present invention relates to new and useful improvements in internal combustion engines and the following listed U.S. patents afford a background understanding of the prior art as presently known by applicant:

| | | |
|---|---|---|
| 1 005 118 | Rabsiliber | Oct 3, 1911 |
| 1 244 566 | White | Oct 30, 1917 |
| 1 623 940 | Mader | Apr 5, 1927 |
| 2 446 280 | Hancock | Aug 3, 1948 |
| 2 670 726 | Spannhake | Mar 2, 1954 |

The Mader patent is pertinent in that it discloses use of a block to increase the compression rate of a cylinder. However, this block is attached to a concave portion of the cylinder head of an engine, and this presents several problems which are difficult to overcome. Normally, an engine cylinder head is formed as a casting and only that part of the head which engages the head gasket is machined. The concave portion to which the Mader block is attached has a rough casting surface, and it is not likely that every concave portion for a particular cylinder is exactly indentical in surface contour to the concave portion for other cylinders. Thus, every Mader block would have to be hand-fitted to provide adequate surface-to-surface contact with the concave portion of the engine head. This would mean that no two blocks would be exactly alike and therefore it would be extremely difficult to provide for the same compression rate in each cylinder of the engine.

Further, the Mader block, as attached to the cylinder head, could not be used with overhead valve engines, since the valves in the latter as so disposed that no suitable block could be disposed in the combustion chamber.

Various of the other patents listed above disclose some sort of attachment to the top surface of a piston but such attachments are not for the purpose of increasing the compression ratio. Included in the prior art are pistons which have integrally formed protuberances on the top surface of the piston, for the purpose of increasing the compression rate, but these require an investment on the part of the engine owner that is great enough to discourage all but the most rabid or wealthy engine enthusiasts. Such increased expense is brought about not only by reason of the fact that all pistons of an engine would have to be replaced with new ones, but also by reason of the fact that this replacement requires substantially a complete disassembly of the engine.

In contrast, the compression-increasing members of my invention may be installed when only the head of the engine is removed. The pistons already in the engine need not be disturbed, except to bring them up to top dead center for attachment of the compression-increasing members. Further, such members may be manufactured and sold in sets of predetermined various sizes so that a desired compression ratio may be effected merely by selecting a corresponding set of members, and applying them to the top surfaces of the engine pistons.

DESCRIPTION OF THE DRAWING

In the drawing accompanying this specification and forming a part of this application, there is shown, for purpose of illustration an embodiment which my invention may assume, and in this drawing:

FIG. 1 is a fragmentary, sectional view through the cylinder of an internal combustion engine, FIG. 2 is a perspective view of a compression-increasing member, FIG. 3 is a fragmentary perspective view of a piston, with a compression-increasing member attached thereto, FIGS. 4 and 5 are top and side views, respectively, of the piston shown in FIG. 3, and FIG. 6 is a perspective view of a template used in the method of assembly.

DESCRIPTION OF THE PREFERRED EMBODIMENT

The internal combustion engine fragmentarily shown in FIG. 1 may be of any well-known overhead valve type, such as the Chevrolet engine. The usual engine includes a block 10 and a head 11 having machined facing surfaces between which a head gasket 12 is tightly clamped by means of bolts (not shown).

A piston 14 of standard construction is reciprocable within the cylinder 15 by a connecting rod 16 which has the usual connection with a crankshaft (not shown). The valves are carried by the head 11, each for reciprocation along a line at an angle to the axis of reciprocation of the related piston 14. Each valve has a stem 17 for engagement with the usual rocker arm (not shown) and a head 18 movable between the full and dotted line positions shown in FIG. 1. Each cylinder has an intake and exhaust valve and because of the compact construction, each piston has a pair of scalloped recesses 19 in its top surface to provide clearance for the valve heads in their open position.

The engine head 11 is cast to provide a combustion chamber 20 for each piston, and a spark plug 21 is screwed into the head and has its sparking points 22 located within the combustion chamber 20 to explode a compressed mixture of fuel and air at the proper time.

The compression ratio is determined by the amount the mixture of fuel and air is compressed within the compression chamber by upward movement of the piston to its upper dead center position. To increase this ratio, it is necessary to decrease the space into which the fuel and air mixture is compressed. My invention provides for an efficient and economical increase of the compression ratio by the attachment of a special member 25 to the top surface of the piston. The usual piston has a flat, imperforate upper surface 26 and rings 27 seated in grooves in its peripheral surface so that the mixture of fuel and air is trapped above the piston and compressed by the upward movement of the piston.

For the purpose of producing the members 25 effeciently in volume production, it is preferable that the same be formed as somewhat semi-circular plates of metal, each having a flat lower surface 28 to match the flat upper surface of the piston. It is preferable that the upper surface 29 of the plate 25 is also flat, and parallel to the plate lower surface in order to provide for accuracy and economy of manufacture, since such surfaces may be surface ground to close tolerances.

The plate 25 is bounded by a circular side wall which is substantially concentric with the piston, and such side wall is inclined, as shown at 30, from a greater radius at its lower surface to a lesser radius at its upper surface. The side wall has a smaller radius than the piston so that in position it is substantially concentric with, but spaced inwardly of the peripheral top edge of the piston. The side wall is of an extent substantially equal to or slightly greater than a half-circle and merges with a flat rectilinear wall 31 which inclines upwardly from the lower surface of the plate. The wall 31 has its lower straight edge alinged with the flat edges of the scalloped recesses 19 and the inclination of the wall 31 avoids interference with the valve heads 18. Since the plate 25 provides an extension into the combustion chamber 20, the side wall is formed with a shallow recess 32 to provide adequate clearance for the spark from the plug 21.

A plate 25 may be attached to the upper surface to a piston in various ways. For example, a metal cement is now available which may be applied between the facing flat surfaces of the plate and piston and permitted to set. A template 33, shown in FIG. 6, may be laid on the upper surface of the piston, the template having a periphery to match that of the top of the piston and/or the top of the cylinder and a cut-out to closely receive the lower end of the side wall 30 and the lower end of the flat inclined wall 31, to accurately disposed the block in position on the piston head. The template may have a recessed portion providing a rectilinear margin 34 to align with the rectilinear margins of the scalloped recesses 19. Instead of cementing the plate in place, or in conjuction with cementing, the plate may be held to the piston by flat-head screws 35. In such case, the plate is formed with openings 36 to pass the screws and the piston is drilled with matching holes to receive the screws. The screws may be of the self-tapping variety, or the holes in the piston may be tapped to provide threads for receiving the screws.

As before mentioned, the prior art includes pistons which have a plate, similar to the plate 25 but formed integrally with the piston. Although this manner of increasing compression ratio is satisfactory, the cost is prohibitive and it does not provide the flexibility of my invention. In order to increase the compression ratio with the pistons of the prior art, the pistons originally in the engine are discarded and replaced with new pistons, and the new pistons will require new rings which must be properly seated. This is not necessary in use of my invention since the original pistons are retained and no new ones are required. The installation of pistons of the prior art is an even costlier operation since the engine must be almost completely dismantled in order to remove the original pistons and install the new ones. Further, the range of compression ratio change with the prior art is limited because the expense of the new pistons makes it economically unfeasible for a dealer or garage to stock sets of pistons for a variety of compression ratio changes.

In contrast with the above-described procedure, my invention provides for a range of compression ratios at a relatively low cost. Since the plates 25 are not integral with the pistons, the cost of replacement of parts is limited only to the cost of the plates. These plates may be manufactured in sets of various thicknesses and/or sizes, each set being adapted to increase the compression ratio a predetermined amount. Thus, because of the relatively low cost, a dealer or garage may stock a number of plate sets so as to be readily available to suit the particular choice of a purchaser.

Installation of the compression-ratio-increasing plates of my invention also represents a decided economy over the prior art in that only the head 11 of the engine need be removed. The original pistons and piston rings need not be disturbed, since all that is necessary is to bring each piston to substantially top dead center so that its upper surface is accessible. The owner or mechanic may then apply the template to the top surface of the respective piston to properly position the plate 25. In the use of cement, the same is applied to the undersurface of the plate prior to its disposition within the template and the plate is pressed into place and the template then removed. In the case of screw fastening, the plate 25 is disposed within the template and hole locations are marked on top of the piston. The plate and template are then removed and the holes drilled (and tapped if required), and the plate then fastened in place. A certain amount of care is needed to avoid any drilling chips from lodging in the cylinder, but since the piston is at its upper position, this is not difficult. Since the plate 25 has a lower flat surface which closely matches the flat upper surface of the piston, it is not disastrous if the holes are drilled completely through the top wall of the piston since the closely matching flat surfaces of the block and piston would prevent leakage of compression.

After all plates have been secured to the engine pistons, the head 11 is replaced and the engine is ready for operation. About the only part to be replaced in this method of installation would be the replacement of the head gasket 12, and this is a minor item.

I claim:

1. In an overhead valve internal combustion engine, including an engine block having at least one cylinder in which a piston is reciprocable along an upright axis between upper and lower positions, said engine also including a head connected to said block to overlie the upper end of said cylinder and to cooperate therewith to form a compression chamber, and intake and exhaust valves mounted on said head for reciprocation along respective axes, each of which is at the same acute angle to the axis of reciprocation of said piston, each of said valves having a flat head movable into said compression chamber when the valve is open, the improvement for increasing the compression ratio of said cylinder, comprising:

a separate metal plate adapted to be attached to the upper face of said piston, said plate being of a peripheral size to lie within the confines of the piston periphery and of a thickness to extend upwardly from said piston face a predetermined amount, said plate having an inclined surface which, when said plate is attached to said piston, is disposed in confronting relation with said valve heads to provide adequate clearance for the latter during opening movement of respective valves.

2. The construction according to claim 1 wherein said piston has a flat upper surface, and wherein said plate is a substantially half round disc with a substantially straight chordal portion, a flat lower side of said disc being attachable flatwise to said piston flat upper surface with the rounded periphery of said disc substantially concentric with the periphery of said piston, and with the straight periphery of said chordal portion confronting said valve heads and having said inclined surface.

3. The construction according to claim 2 wherein a portion of said rounded periphery, when said disc is attached to said piston, is in confronting relation with the spark gap of a spark plug carried by said head, and wherein said portion of said rounded periphery has a groove in its upper surface to provide adequate clearance for the spark at said gap.

4. The construction according to claim 2 wherein said disc is cemented to said piston.

5. The construction according to claim 2 wherein said disc is connected to said piston by a threaded fastener.

* * * * *